US009976269B2

(12) United States Patent
Zwickl et al.

(10) Patent No.: US 9,976,269 B2
(45) Date of Patent: May 22, 2018

(54) SCREEN BELT SYSTEM FOR A BEACH CLEANING VEHICLE AND BEACH CLEANING VEHICLE

(71) Applicants: Patrick Zwickl, Jettingen-Scheppach (DE); Marc Giet, Ulm (DE)

(72) Inventors: Patrick Zwickl, Jettingen-Scheppach (DE); Marc Giet, Ulm (DE)

(73) Assignee: KAESSBOHRER GELAENDEFAHRZEUG AG, Laupheim (DE)

( * ) Notice: Subject to any disclaimer, the term of this patent is extended or adjusted under 35 U.S.C. 154(b) by 0 days. days.

(21) Appl. No.: 15/420,752

(22) Filed: Jan. 31, 2017

(65) Prior Publication Data

US 2017/0254036 A1 Sep. 7, 2017

(30) Foreign Application Priority Data

Mar. 2, 2016 (DE) ..... 10 2016 203 381

(51) Int. Cl.
*B07B 1/10* (2006.01)
*E01H 12/00* (2006.01)
(Continued)

(52) U.S. Cl.
CPC ..... *E01H 12/002* (2013.01); *B07B 1/005* (2013.01); *B07B 1/10* (2013.01); *B07B 1/4672* (2013.01)

(58) Field of Classification Search
CPC ..... E01H 12/00; E01H 12/002; B07B 1/005; B07B 1/10; B07B 1/4672
(Continued)

(56) References Cited

U.S. PATENT DOCUMENTS 1,997,713 A * 4/1935 Boehm ..... B07B 1/4663 139/425 R
3,362,480 A * 1/1968 Barber ..... E01H 12/00 171/89
(Continued)

FOREIGN PATENT DOCUMENTS

CA 2710609 A1 * 7/2009 ..... B62D 55/253
CA 2710609 A1 * 7/2009 ..... B62D 55/253
(Continued)

OTHER PUBLICATIONS

Search Report of European Patent Office issued in Application No. 17 15 0937 with English translation of category of cited documents dated Aug. 10, 2017 (9 pages).
(Continued)

*Primary Examiner* — Terrell H Matthews
(74) *Attorney, Agent, or Firm* — Flynn, Thiel, Boutell & Tanis, P.C.

(57) ABSTRACT

A screen belt system for a beach cleaning vehicle, including a flexible, sheet-type screen belt arrangement which is deflected by at least two deflection shafts, with at least one thereof being driven by a drive unit. The screen belt arrangement is provided with lengthwise extending outer straps on opposite longitudinal sides, and has at least one screen belt fabric. Transversely extending reinforcing profiles are also provided, each extending over a working width of the at least one screen belt fabric and being connected to the at least one screen belt fabric and attached to the outer straps on the face end side.

18 Claims, 7 Drawing Sheets

(51) Int. Cl.
*B07B 1/00* (2006.01)
*B07B 1/46* (2006.01)

(58) Field of Classification Search
USPC ..... 209/307, 400, 401, 421
See application file for complete search history.

(56) References Cited

U.S. PATENT DOCUMENTS 3,700,105 A * 10/1972 Piper ..... B07B 1/42 180/53.61
4,146,483 A 3/1979 Lee
4,491,517 A 1/1985 Janovac
4,909,929 A * 3/1990 Tabor ..... B01D 25/002 209/395
5,003,731 A * 4/1991 Durr ..... B07B 1/10 198/833
5,863,430 A * 1/1999 Williams ..... B01D 33/04 175/206
6,094,847 A * 8/2000 Gallenberg ..... A01D 17/10 171/118
6,805,204 B2 * 10/2004 Bauer ..... E01H 12/00 111/143
8,579,039 B2 * 11/2013 Spindler ..... E01H 12/00 171/124
8,783,468 B2 * 7/2014 Roden ..... B07B 1/10 209/233
8,829,396 B2 * 9/2014 Rey Garcia ..... B65G 17/12 198/339.1
2002/0170765 A1 * 11/2002 Bauer ..... E01H 12/00 180/308
2011/0180280 A1 7/2011 Spindler et al.

FOREIGN PATENT DOCUMENTS

DE 101 13 702 A1 10/2002
DE 10 2010 006 278 A1 7/2011
FR 2 369 020 A1 5/1978
JP 02261111 A 10/1990

OTHER PUBLICATIONS

Search Report of German Patent Office issued in Application No. 10 2016 203 381.6 dated Jul. 26, 2016 (5 pages).

* cited by examiner

SCREEN BELT SYSTEM FOR A BEACH CLEANING VEHICLE AND BEACH CLEANING VEHICLE

CROSS-REFERENCE TO RELATED APPLICATIONS

This claims priority from German Patent Application No. 10 2016 203 381.6, filed on Mar. 2, 2016, the disclosure of which is hereby incorporated by reference in its entirety into this application.

FIELD OF THE INVENTION

The invention relates to a screen belt system for a beach cleaning vehicle, comprising a flexible, sheet-type screen belt arrangement which is deflected by means of at least two deflection shafts, with at least one thereof being driven by a drive unit. The invention also relates to a beach cleaning vehicle including such a screen belt system.

BACKGROUND OF THE INVENTION

A beach cleaning vehicle having such a screen belt system is disclosed in DE 10 2010 006 278 A1. The beach cleaning vehicle is a vehicle pulled by a tractor. The beach cleaning vehicle includes a screen belt arrangement which is configured as a flexible, flat belt deflected over two rolls arranged on opposite ends of the belt. The screen belt arrangement forms an endless circulating belt. The screen belt arrangement is driven, wherein circulation of the screen belt arrangement during operation of the beach cleaning vehicle is achieved by a drive acting on at least one roll.

SUMMARY OF THE INVENTION

An object of the invention is to provide a screen belt system and a beach cleaning vehicle of the above mentioned type, which have a fail-save design and allow good performance and consistent screening function.

This object is achieved for the screen belt system in that the screen belt arrangement is provided with lengthwise extending outer straps on opposite longitudinal sides, in that the screen belt arrangement has at least one screen belt fabric, and in that transversely extending reinforcing profiles are provided, each extending over a working width of the at least one screen belt fabric and being connected to the at least one screen belt fabric and attached to the outer straps on the face end side. As a result, the screen belt arrangement is composed of a compound of at least one screen belt fabric, the lengthwise extending outer straps and transversely extending reinforcing profiles. Thereby, an elongation of the screen belt arrangement is prevented, so that even over a long operating period of the beach cleaning vehicle a reliable and fail-save screening effect is achieved. According to the invention, the definition of the lengthwise extending outer straps and the transversely extending reinforcing profiles is related to circulation of the screen belt arrangement. The term "in the direction of circulation" means extending lengthwise. The term "transversely extending" means, however, that the reinforcing profiles extend along a working width of the screen belt arrangement and, thus, transversely to the direction of circulation. Consequently, the transversely extending reinforcing profiles are oriented in parallel to rotational axes of the deflection shafts. The deflection shafts can be configured as rolls or also as drive wheel shafts, wherein in the latter case multiple drive wheels are held on a shaft rotating about the rotational axis. The solution according to the invention is suitable both for pulled and also for self-propelled beach cleaning vehicles.

In an embodiment of the invention, the outer straps are provided with profilings in the region of their interior sides facing the deflection shafts, and at least one deflection shaft has two drive wheels provided with complementary outer profilings, which wheels are held on a common shaft and cooperate with the profilings of the outer straps in a form-fitting manner. The profilings and the complementary outer profilings are matched to one another such that form-fitted entrainment of the outer straps is obtained in the rotating direction of the drive wheels. Consequently, according to the invention, the screen belt arrangement is driven via the two outer straps, which are transported and deflected on the drive wheels without slip. The screen belt arrangement and also the outer straps are in an endless circulating configuration. The outer straps delimit the screen belt arrangement on opposite longitudinal sides in the working width thereof.

In a further embodiment of the invention, the screen belt arrangement has at least one screen belt fabric which is configured as a metallic braided fabric. Preferably, the metallic braided fabric is made of a steel alloy. Depending on the working width of the screen belt arrangement, merely one single screen belt fabric is provided or at least two side-by-side arranged screen belt fabrics are provided, wherein adjacent screen belt fabrics are respectively interconnected by a central strap.

In a further embodiment of the invention, the reinforcing profiles penetrate through loops of the braided fabric. The, in particular rod-shaped, reinforcing profiles extend through the loops of the braided fabric, which are designed in the type of eyelets. Thereby, a form-fitted connection between the reinforcing profiles and the respective braided fabric is obtained, without additional fixing means required in the region of the loops of the braided fabric for anchoring of the reinforcing profiles. As a result, the outer straps, the reinforcing profiles and the at least one screen belt fabric form a sturdy compound. The synchronous drive of the screen belt arrangement via the profilings of the outer straps ensures slip-free transport, i.e., slip-free circulation of the screen belt arrangement.

In a further embodiment of the invention, the screen belt arrangement includes at least two screen belt fabrics arranged side-by-side in parallel, with a lengthwise extending central strap interposed between them, which central strap is connected to the transversely extending reinforcing profiles. The central strap and the reinforcing profiles ensure that there is no detrimental extension occurring in a central region of the screen belt arrangement, which could cause sagging.

In a further embodiment of the invention, each screen belt fabric, on an exterior side facing away from the central strap, is connected to a respective outer strap extending in parallel to the central strap. Consequently, the two outer straps delimit the screen belt arrangement on opposite longitudinal sides in the working width thereof.

In a further embodiment of the invention, the reinforcing profiles are attached to the central strap and/or to at least one outer strap. Attachment is preferably by mechanical fixation means like, in particular riveted or screwed connections. The reinforcing profiles are preferably made of steel or a fiber-reinforced synthetic material.

In a further embodiment of the invention, the central strap and the outer straps are provided with profilings in the region of their interior sides facing the deflection shafts, and at least one driven deflection shaft includes three drive wheels provided with complementary outer profilings, which wheels are held on a common shaft and cooperate with the profilings of the central and outer straps, respectively. The drive wheels are attached in a rotationally fixed manner to the shaft which is mounted for rotation about a rotational axis. The shaft together with the drive wheels forms a deflection shaft within the sense of the invention. Preferably, the described deflection shaft constitutes the drive shaft to which force is applied by the drive unit and which shaft moves the screen belt arrangement.

In a further embodiment of the invention, at least the outer straps are provided with additional cams in the region of their exterior side, located opposite the interior side. The additional cams are a protection against rapid wear. Furthermore, the cams are to improve transport of the screen belt arrangement in the region of the lower run thereof, in that an improved guidance is achieved in the region of at least one guide roller, which can likewise be provided with cams cooperating with the additional cams of the exterior side of the outer straps. In the region of the lower run of the screen belt arrangement, the exterior side of the outer straps is led over a guide roller so that the additional cams in the region of the guide roller can cooperate with corresponding cams of the guide roller.

In a further embodiment of the invention, the transversely extending reinforcing profiles are spread over an entire width of the two screen belt fabrics. Thus, the reinforcing profiles extend over the entire working width of the screen belt arrangement.

In a further embodiment of the invention, the transversely extending reinforcing profiles are spread merely partially over a width of one respective screen belt fabric and are arranged offset in relation to each other in the transverse direction. In this alternative, the reinforcing profiles extend merely completely over the width of one respective screen belt fabric and protrude merely partially from the central strap into the other screen belt fabric. Owing to the offset arrangement, reinforcing profiles adjacent in the longitudinal direction extend alternatingly either over the left half of the screen belt arrangement or over the right half of the screen belt arrangement, respectively. This allows different subdivisions of the working width to be achieved, and in particular also to combine screen belt fabrics of different widths in parallel side-by-side arrangement.

In a further embodiment of the invention, transversely extending support rods are attached to the central strap, which rods reach into the two adjacent screen belt fabrics in equal amounts. The support rods are for reinforcing the central region of the screen belt arrangement. From the central strap, the rods project in a T-shape into screen belt fabrics adjacent to the left and right hand sides. In this context, the support rods penetrate through corresponding loops of the braided fabrics of the screen belt fabrics in a manner similar to that featured with the reinforcing profiles.

For the beach cleaning vehicle, the object of the invention is achieved in that a screen belt system presenting at least one of the above described features is provided. Such a beach cleaning vehicle can be a pulled vehicle according to the kind as described in DE 10 2010 006 278 A1, or a self-propelled vehicle according to the variant as described in DE 10 113 702 B4.

Further advantages and features of the invention will become apparent from the claims and from the description below of preferred exemplary embodiments of the invention, illustrated with reference to the drawings.

DETAILED DESCRIPTION OF THE DRAWINGS

Figure 2:
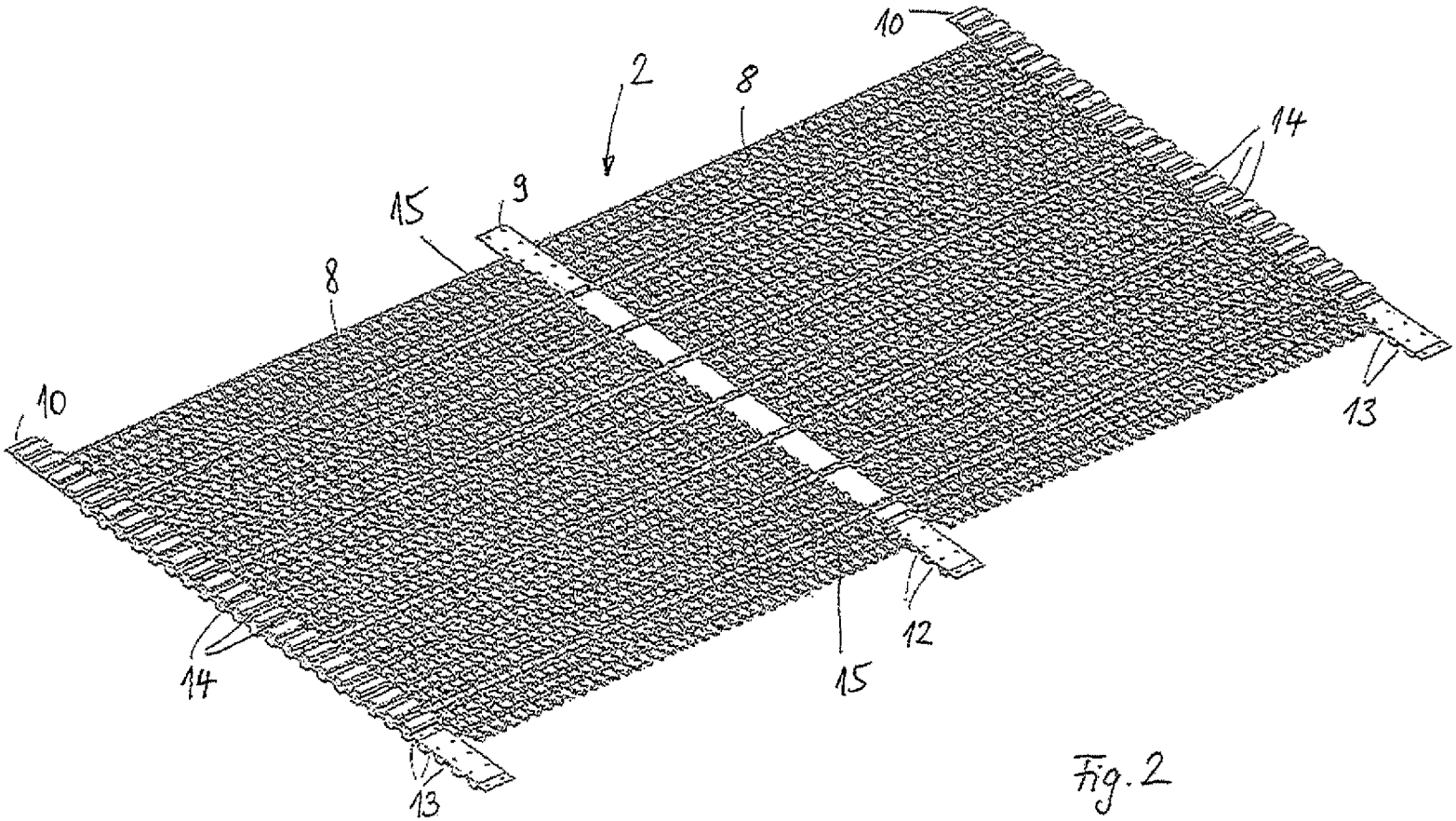
FIG. 2 shows a perspective illustration of a detail of a screen belt arrangement of the screen belt system according to FIG. 1.
Figure 4A:
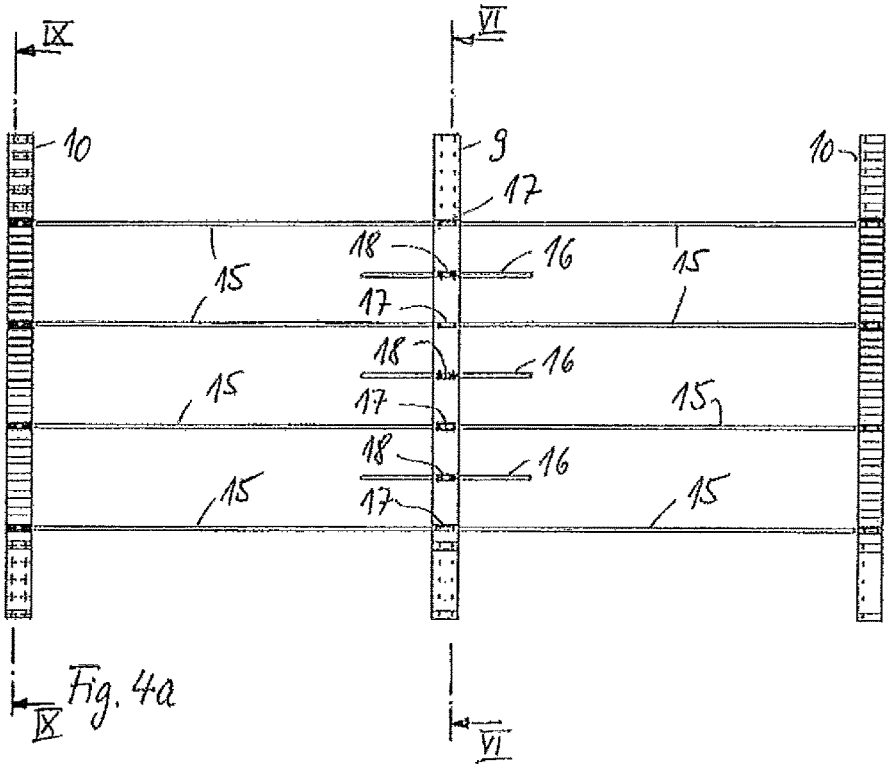
Figure 4B:
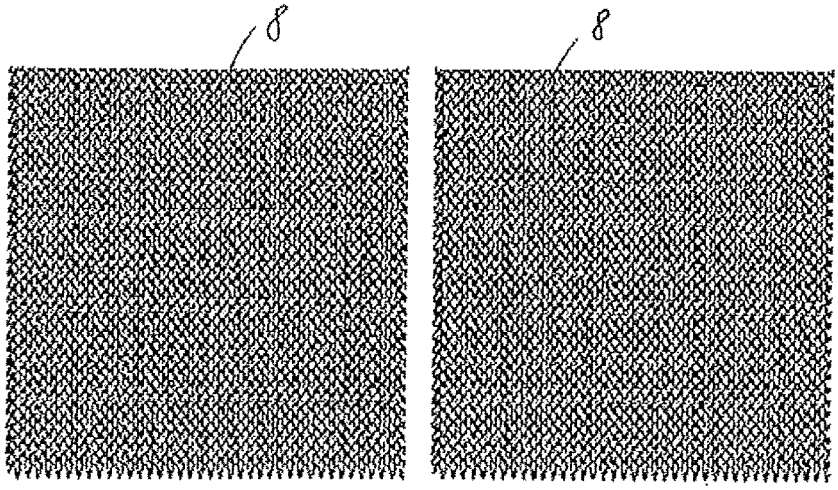
Figure 5:
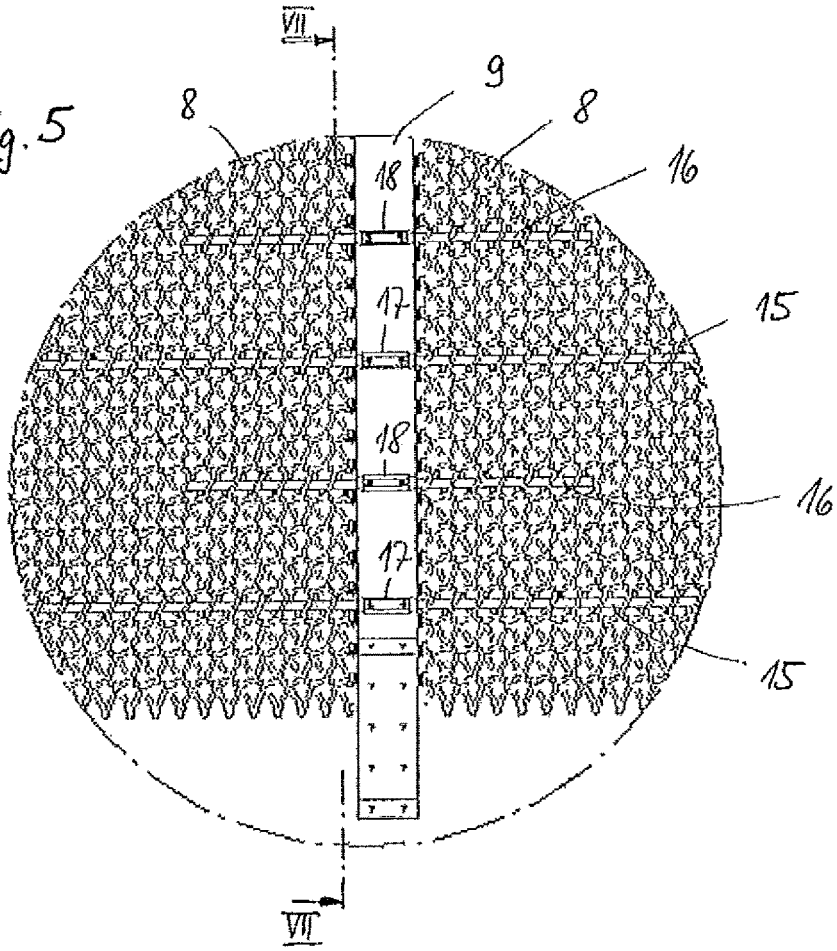
Figure 6:
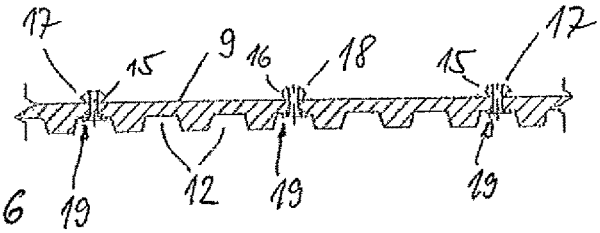

FIG. 4*a* shows a reinforcing compound of the screen belt arrangement according to FIG. 2 with the screen belt fabric omitted;

FIG. 4*b* shows two adjacent screen belt fabrics for the reinforcing compound according to FIG. 4*a* for forming the screen belt arrangement according to FIG. 2;

FIG. 5 shows an enlarged top view of a section of the screen belt arrangement according to FIG. 2;

FIG. 6 shows a longitudinal section of a detail of a central strap in the region of the section line VI-VI in FIG. 4*a;*

Figure 3:
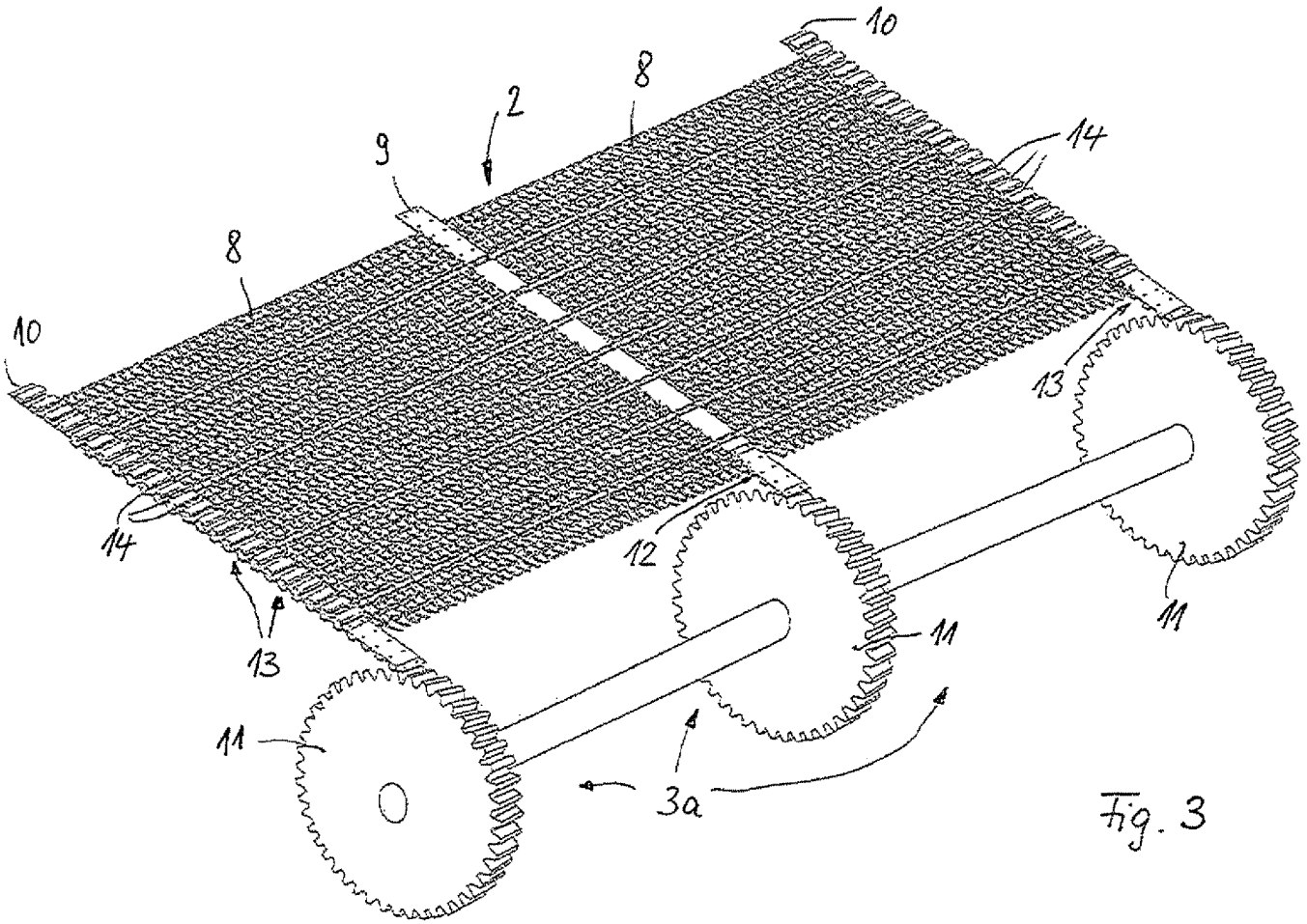
FIG. 3 shows a schematic view of the screen belt arrangement according to FIG. 2 in cooperation with a deflection shaft constituted by drive wheels.
Figure 7:
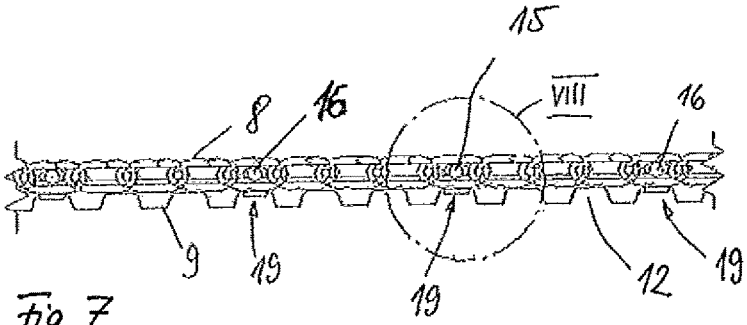
Figure 8:
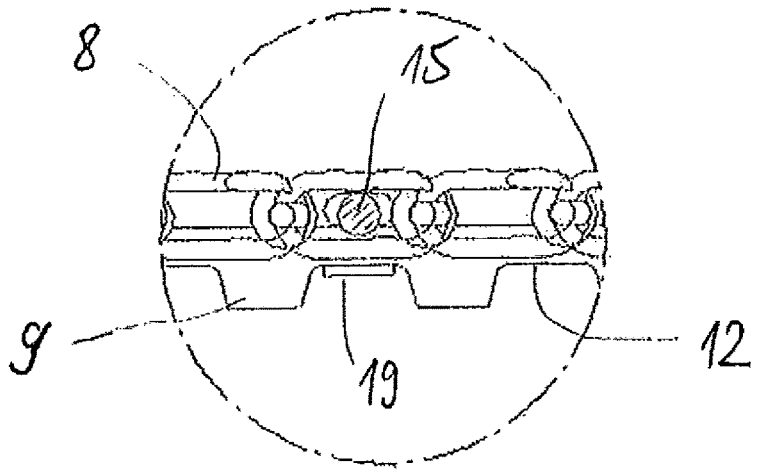
Figure 9:
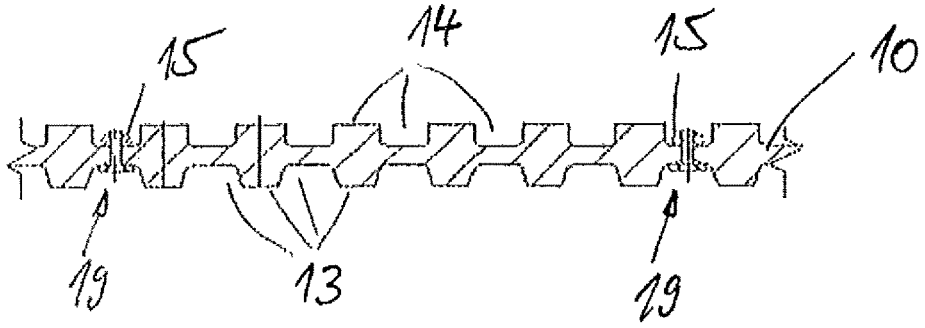
Figure 10:
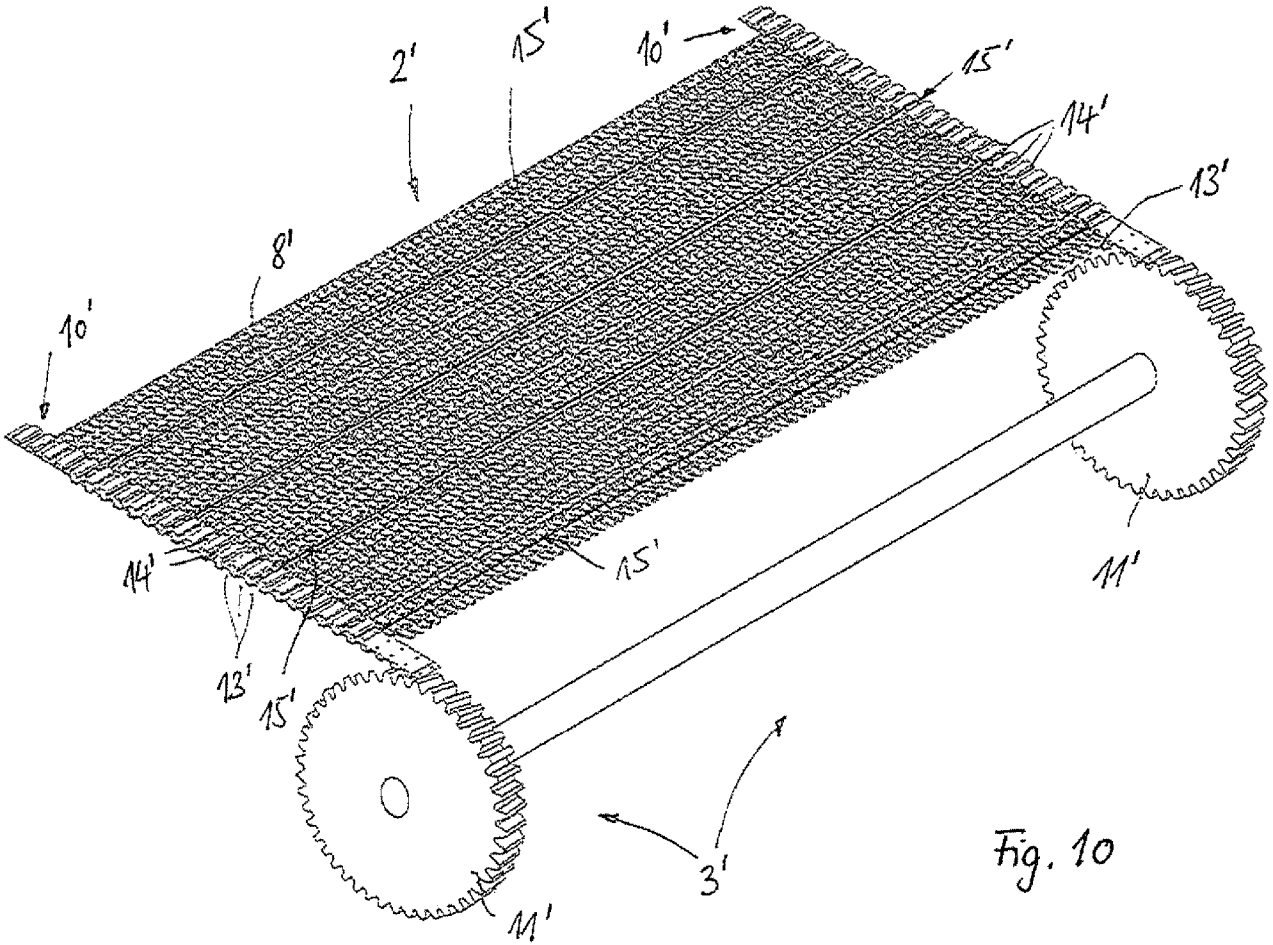

FIG. 7 shows a longitudinal section along the section line VII-VII of a detail of the screen belt arrangement according to FIGS. 2 and 5;

FIG. 8 shows an enlarged illustration of a section VIII of the screen belt arrangement according to FIG. 7;

FIG. 9 shows a longitudinal section along the section line IX-IX in FIG. 4*a* of a detail of an outer strap of the screen belt arrangement according to FIG. 2; and FIG. 10 shows another screen belt arrangement of an embodiment of a screen belt system according to the invention similar to FIG. 3.

DETAILED DESCRIPTION

Figure 1:
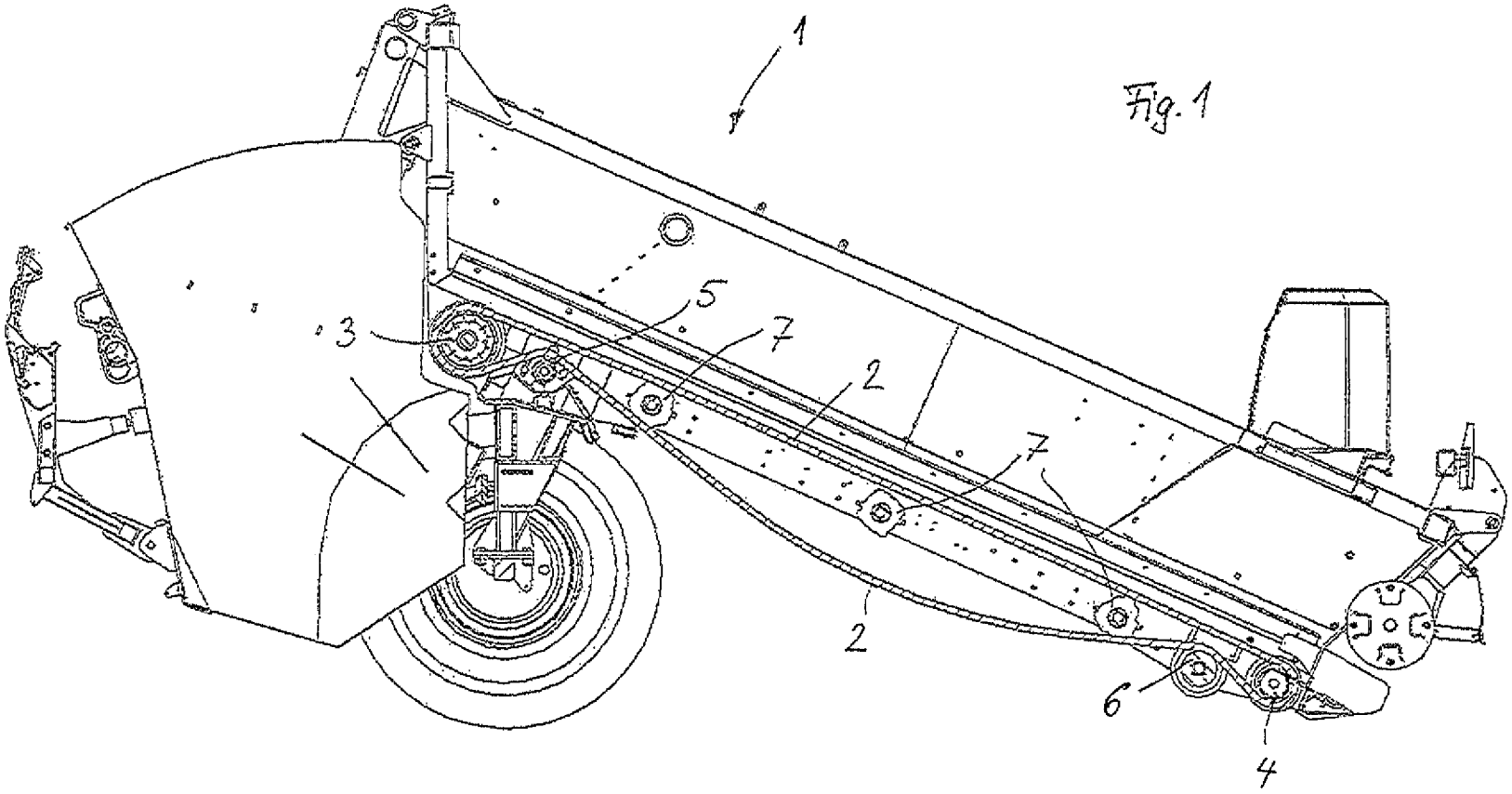
FIG. 1 shows a schematic side view of an embodiment of a beach cleaning vehicle according to the invention with an embodiment of a screen belt system according to the invention.

A beach cleaning vehicle 1 according to FIG. 1 is intended for being pulled by a tractor. The beach cleaning vehicle 1 includes a single wheel axle. The beach cleaning vehicle 1 is to collect a sand-dirt-conglomeration along a sandy beach and to convey it to the rear on a screen belt system, wherein small particles, like sand in particular, can fall through a screen belt arrangement 2 of the screen belt system back down again onto the sandy ground, whereas coarser dirt, like waste, deposited flotsam and similar are conveyed rearwards to a dirt container via the screen belt system.

The screen belt system includes an endless circulating screen belt arrangement 2 which is deflected on the front and rear sides by a respective deflection shaft 3, 4. The deflection shaft 3 is configured as a drive shaft which is driven by a drive unit (not illustrated in more detail). Furthermore, a lower run of the screen belt arrangement 2 is guided over two guide rollers 5, 6. A multitude of vibratory rollers 7 act on an evenly stretched upper run of the screen belt arrangement 2 and improve separation of the sand-dirt-conglomeration. The screen belt arrangement 2 is described below in more detail with reference to FIGS. 2 through 9.

The screen belt arrangement 2 is circulating endlessly in the longitudinal direction of the beach cleaning vehicle 1. With reference to FIGS. 2 through 9, the screen belt arrangement is illustrated and described in detail merely over a partial section of its length, but over its complete working width. The configuration of the screen belt arrangement 2 is not varied in the not illustrated sections and regions, so that the explanations given below apply to the entire screen belt arrangement 2.

The screen belt arrangement 2 includes two screen belt fabrics 8 arranged side-by-side in parallel, which in the exemplary embodiment as illustrated have the same width and are designed as circulating endless sheet. The two screen belt fabrics 8 are arranged in parallel and adjacent along the longitudinal direction. Both of the screen belt fabrics 8 have an identical design and are produced as metallic braided fabric, wherein corresponding metallic warp and weft wires build three-dimensional loops or eyelets. Over their entire length in the region of the center of the screen belt arrangement 2, the two screen belt fabrics 8 are connected to a central strap 9 circulating in the longitudinal direction, which central strap extends between the adjacent screen belt fabrics 8. For that purpose, a multitude of reinforcing profiles 15, extending in the transverse direction and in parallel to each other, penetrate through corresponding loops of the screen belt fabric 8, which profiles are integrated in the two screen belt fabrics 8 at uniform intervals and attached to the central strap 9. The reinforcing profiles 15 are metal rods, preferably steel rods. In the region of the central strap 9 the reinforcing profiles 15 are provided with flattened portions 17, each thereof having two respective through bores. The central strap 9 is provided with corresponding holes in analogy to the location of the through bores, and through the holes, mechanical fixation means connect the flattened portions of the reinforcing profiles to the central strap 9.

As is apparent with reference to FIGS. 5 through 8, riveted connections 19 are provided in order to attach the flattened portions 17 of the reinforcing profiles 15 to the central strap 9. The corresponding riveted connections 19 have riveted plates in the region of a bottom side. Corresponding rivets protrude through the holes of the central strap 9 and through the through bores of the flattened portions of the reinforcing profiles 15. By means of a corresponding fixation of the rivet, the desired attachment of the reinforcing profiles 15 on the central strap 9 is obtained.

The reinforcing profiles 15 extend over the entire working width of the screen belt arrangement 2 and are connected to two outer straps 10 on opposite face ends thereof, with the outer straps extending in parallel to the central strap 9 and flanking the respective screen belt fabric 8 on the exterior side. Corresponding end face regions of the reinforcing profiles 15 are flattened in a similar manner in the region of the outer straps 10 and provided with through bores, as in the case of the region of the central strap. The outer straps 10 also have holes matched to the through bores. In a similar manner as with the central strap 9, the outer straps are also provided with corresponding riveted connections 19 intended for attachment of the face end regions of the reinforcing profiles to the two outer straps 10. Attachment via the riveted connections 19 is in a similar manner as with the central straps 9 and, thus, reference is made to the description related to the attachment of the central strap 9. With reference to FIG. 9, the connection of the reinforcing profiles 15 to the respective outer strap 10 is illustrated.

With reference to FIGS. 2 and 5, it is apparent that the rod-shaped reinforcing profiles 15 are led through corresponding loops of the fabric over the entire width of the respective screen belt fabric 8 so that, over the entire width, a form-fitted connection is obtained between the reinforcing profiles 15 and the respective screen belt fabric 8 in the longitudinal direction. As a result, the reinforcing profiles 15 prevent displacement or elongation of the screen belt fabrics 8 in the longitudinal direction.

In order to achieve further improved reinforcement and supporting in a central region of the working width of the screen belt arrangement 2, additional, respectively alternating support rods 16 are provided in the region of the central strap 9 between the reinforcing profiles 15, which rods extend from the central strap 9 over a portion of the respective width of the screen belt fabrics 8 into the latter, whereby a central strip of the screen belt arrangement 2 is given additional reinforcement. The support rods 16 are provided with flattened portions 18, which have a design identical to that of the flattened portions 17 of the reinforcing profiles 15. The support rods 16 are also metallic profiles, in the present case steel rods, in analogy to the reinforcing profiles 15. The flattened portions 18 are provided with through bores to which complementary holes are assigned in the region of the central strap 9. Riveted connections 19 are for attaching the support rods to the central strap 9, in a similar manner as with attaching the reinforcing profiles 15 to the central strap 9 and to the outer straps 10. The support rods 16 penetrate corresponding loops of the two screen belt fabrics 8 in a similar manner as in the case of the reinforcing profiles 15. The only difference is in that the support rods 16 project freely into the loops of the two screen belt fabrics 8 and extend merely in the central region of the screen belt arrangement 2, i.e., in the region of the central strip.

With reference to FIGS. 2 through 9, it is also apparent that both the central strap 9 and the outer strap 10 are provided with profilings in the form of cams 12, 13 in the region of their interior sides facing the deflection shafts 3, 4. The central strap 9 is provided with the cams 12 in the region of the interior side thereof. In the region of the exterior side, the central strap 9 has an essentially flat surface, whereon the flattened portions 17, 18 of the reinforcing profiles 15 and the support rods 16 are attached. In contrast, the outer straps 10 are provided with additional cams 14 also in the region of the exterior side thereof, i.e., opposite the cams 13 of the interior side, which cams 14 extend in the transverse direction in a manner identical to that of the cams 13, 12 of the outer straps 10 and the central strap 9. With reference to FIG. 3, a variant according to the invention is illustrated, wherein the deflection shaft 3*a* acting as a drive shaft comprises drive wheels 11, said wheels provided with three outer cams serving as outer profiling, which drive wheels are held on a common shaft in a rotationally fixed manner. The outer cams of the drive wheels 11 are complementary to the cams 12, 13 and are for form-fitting engagement in the cams 12, 13 of the central strap 9 and the outer straps 10 and, thus, to achieve form-fitted, slip-free transport of the screen belt arrangement 2 in the region of the drive shaft 3*a*. In the embodiment as illustrated in FIG. 1, the deflection shaft 3 acting as a drive shaft is a driving roll which is provided with a rubber lining on the outer sheath thereof.

The additional cams 14 on the exterior sides of the outer straps 10 are intended to achieve improved transport of the screen belt arrangement 2 in the region of the guide rollers 6, 7, across which the screen belt arrangement 2 is guided. Furthermore, the additional cams 14 are a protection against early wear of the outer straps 10.

Also, the deflection shaft 4 can be provided with rolls or wheels in a similar manner as the deflection shaft 3*a*, with the outer circumference thereof having outer cams which are complementary to the additional cams 14 of the outer straps 10.

A screen belt arrangement 2' according to FIG. 10 is employable in a screen belt system of a beach cleaning vehicle according to FIG. 1 in a similar manner as with the screen belt system according to FIGS. 2 through 9. An essential difference of the screen belt system according to FIG. 10 is in that the screen belt arrangement 2' has a smaller working width than the screen belt arrangement 2 according to FIG. 3. Owing to the reduced working width, it is sufficient to provide merely a single screen belt fabric 8' which is a metallic braided fabric configured in a similar manner as the above described screen belt fabrics 8. To avoid repetitions, reference is made to the explanations in relation to the screen belt system according to FIGS. 2 through 9. Components or sections of equal function are marked with the same reference numerals and an apostrophe ' added thereto. The screen belt arrangement 2' is also provided with two outer straps 10' on opposite longitudinal sides in the direction of transport, i.e., as seen in the direction of circulation of the screen belt arrangement 2', which have a design identical to that of the outer straps 10 of the screen belt arrangement 2 according to FIG. 3. The screen belt arrangement 2' does not need a central strap, owing to the smaller working width. As well, the screen belt arrangement 2' is driven in circulation by drive wheels 11' provided with outer profilings in the form of outer cams, which wheels are held on a common shaft in a rotationally fixed manner. The drive wheels 11' and the shaft constitute the driven deflection shaft 3' positioned in the beach cleaning vehicle in analogy to the deflection shaft 3 according to FIG. 1. The two drive wheels 11' drive the two outer straps 10' of the screen belt arrangement 2' via the (not illustrated) drive unit in a synchronous and slip-free manner. For that purpose, the outer straps 10' have profilings 13' which are configured to be complementary to the outer profilings of the drive wheels 11'. In the circumferential direction of the drive wheels 11' and, thus, in the conveying direction of the outer straps 10', the profilings 13' and the outer profilings of the drive wheels 11' mesh in a form-fitting manner. The profilings 13' have a cam-shape, wherein the cams extend over an entire width of the respective outer strap 10' in the transverse direction. The outer profilings of the drive wheels 11' are provided as a type of front cams on the exterior circumference of the respective drive wheel 11' and each extend likewise in the transverse direction. The two outer straps 10' are connected to corresponding longitudinal edges of the screen belt fabric 8' over multiple, transversely extending reinforcing profiles 15'. The reinforcing profiles 15' are disposed at uniform intervals over the length of the screen belt fabric 8' and each extend in the transverse direction over the entire working width of the screen belt fabric 8'. The reinforcing profiles 15' have a rod-shape and are flattened on opposite face end regions thereof and connected to the respective outer strap 10' via mechanical fixation means in the form of riveted connections, in analogy to the connection of the reinforcing profiles 15 to the outer straps 10 and the central strap 9, respectively, in the above described embodiment. Again, to avoid repetitions, reference is made to the detailed description of the attachment of the reinforcing profiles 15 to the outer straps 10 and the central strap 9, respectively. The reinforcing profiles 15' have a rod-shape and are led through corresponding eyelets or loops of the metallic braided fabric in the transverse direction such that the corresponding looping through produces a form-fitted connection between the reinforcing profiles 15' and the screen belt fabric 8' in the transport direction of the screen belt fabric 8'. The reinforcing profiles 15' fixed to the outer straps 10' necessarily cause entrainment of the screen belt fabric 8' in the conveying direction during corresponding conveyance of the outer straps 10' by the drive wheels 11', since the reinforcing profiles 15' are anchored on the screen belt fabric 8' over the entire working width of said fabric. As a result, slip-free and synchronous conveying of the circulating screen belt arrangement 2' in the direction of circulation is achieved. Sagging of the screen belt fabric 8' towards the center is prevented in a similar manner as non-uniform elongation of the screen belt fabric 8' in the transport direction, i.e., the direction of circulation.

The invention claimed is:

1. Screen belt system for a beach cleaning vehicle, comprising a flexible, sheet-type screen belt arrangement, which is deflected by means of at least two deflection shafts, with at least one thereof being driven by a drive unit, wherein the screen belt arrangement is provided with lengthwise extending outer straps on opposite longitudinal sides, the screen belt arrangement having at least one screen belt fabric, and transversely extending reinforcing profiles are provided, each extending over a working width of the at least one screen belt fabric and being connected to the at least one screen belt fabric and attached to the outer straps on the face end side.

2. Screen belt system according to claim 1, wherein the outer straps are provided with profilings in the region of their interior sides facing the deflection shafts, and at least one deflection shaft has two drive wheels provided with complementary outer profilings, which wheels are held on a common shaft and cooperate with the profilings of the outer straps in a form-fitting manner.

3. Screen belt system according to claim 1, wherein the at least one screen belt fabric is configured as a metallic braided fabric.

4. Screen belt system according to claim 3, wherein the reinforcing profiles penetrate through loops of the braided fabric.

5. Screen belt system according to claim 1, wherein the screen belt arrangement includes at least two screen belt fabrics arranged side-by-side in parallel, with a lengthwise extending central strap interposed between them, which central strap is connected to the transversely extending reinforcing profiles.

6. Screen belt system according to claim 5, wherein each screen belt fabric, on an exterior side facing away from the central straps, is connected to a respective outer strap extending in parallel to the central strap.

7. Screen belt system according to claim 1, wherein the reinforcing profiles have a rod-shaped design.

8. Screen belt system according to claim 5, wherein the reinforcing profiles are attached to the central strap and/or to at least one outer strap.

9. Screen belt system according to claim 5, wherein the central strap and the outer straps are provided with profilings in the region of their interior sides facing the deflection shafts, and at least one deflection shaft includes three drive wheels provided with complementary outer profilings, which wheels are held on a common shaft and cooperate with the profilings of the central and outer straps, respectively.

10. Screen belt system according to claim 1, wherein at least the outer straps are provided with additional cams in the region of their exterior side located opposite the interior side.

11. Screen belt system according to claim 5, wherein the transversely extending reinforcing profiles are spread over an entire width of the two screen belt fabrics.

12. Screen belt system according to claim 1, wherein the transversely extending reinforcing profiles are spread merely partially over a width of a respective screen belt fabric and are arranged offset in relation to each other in the transverse direction.

13. Screen belt system according to claim 5, wherein transversely extending support rods are attached to the central strap, which rods reach into the two adjacent screen belt fabrics in equal amounts.

14. Beach cleaning vehicle, including a screen belt system according to claim 1.

15. A loose-surface cleaning device comprising:

a drive axle;

a drive wheel attached to the drive axle; and a screen belt comprising:

at least one elongated screen comprised of fabric, having a width and having openings large enough for surface particles to fall through, an edge strap attached to the fabric screen, the edge strap configured for engagement with the drive wheel, and a plurality of elongated reinforcements extending through at least a portion of the width of the fabric screen and being attached to the edge strap, wherein the drive axle turns the at least one drive wheel which engages the edge strap of the screen belt to move the screen belt to separate debris from surface material.

16. The loose-surface cleaning device according to claim 15, wherein the at least one elongated screen is a first screen and the screen belt further comprises a second screen comprised of fabric.

17. The loose-surface cleaning device according to claim 15, wherein the edge strap is a first edge strap and the at least one elongated screen belt further comprises a second, opposing edge strap.

18. The loose-surface cleaning device according to claim 15, wherein the at least one screen has loops through which the reinforcements extend.

* * * * *